US006712052B2

(12) United States Patent
Itoh

(10) Patent No.: US 6,712,052 B2
(45) Date of Patent: Mar. 30, 2004

(54) ENGINE CONTROL UNIT

(75) Inventor: Nozomi Itoh, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/115,904

(22) Filed: Apr. 5, 2002

(65) Prior Publication Data

US 2002/0148454 A1 Oct. 17, 2002

(30) Foreign Application Priority Data

Apr. 5, 2001 (JP) ..... 2001-107144

(51) Int. Cl.[7] ..... F02P 23/00
(52) U.S. Cl. ..... 123/647
(58) Field of Search ..... 123/647, 468, 123/469, 184.38, 184.42, 195 E, 143 C

(56) References Cited

U.S. PATENT DOCUMENTS 5,003,933 A * 4/1991 Rush et al. ..... 123/184.42
5,117,932 A * 6/1992 Kurosu et al. ..... 180/68.2
5,207,186 A * 5/1993 Okita ..... 123/41.31
5,295,861 A * 3/1994 Peretick et al. ..... 439/527
5,357,931 A * 10/1994 Semence ..... 123/456
5,447,140 A * 9/1995 Brisbane et al. ..... 123/456
5,568,794 A * 10/1996 Tabuchi et al. ..... 123/195 E
5,713,322 A * 2/1998 Mausner et al. ..... 123/184.21
5,771,850 A * 6/1998 Okada ..... 123/143 C
5,996,543 A * 12/1999 Nakayama et al. .... 123/184.21
6,186,106 B1 * 2/2001 Glovatsky et al. ..... 123/143 C
6,252,320 B1 * 6/2001 Ballard et al. ..... 310/68 D
6,299,469 B1 * 10/2001 Glovatsky et al. ..... 439/329
6,308,686 B1 * 10/2001 Mammarella et al. ..... 123/470
6,357,414 B1 * 3/2002 Kalinowski et al. .... 123/198 E
6,408,811 B1 * 6/2002 Glovatsky et al. ..... 123/184.61
6,494,174 B1 * 12/2002 Daly ..... 123/143 C
6,494,186 B1 * 12/2002 Wakeman ..... 123/479
6,502,547 B2 * 1/2003 Kennedy et al. ..... 123/399
6,508,666 B1 * 1/2003 Francis ..... 439/548
6,513,479 B2 * 2/2003 Nozaki et al. ..... 123/198 E

* cited by examiner

*Primary Examiner*—Mahmoud Gimie
*Assistant Examiner*—Hai Huynh
(74) *Attorney, Agent, or Firm*—Foley & Lardner

(57) ABSTRACT

An engine control unit having electronic components and various circuits for controlling an engine is mounted on a portion substantially just above an intake manifold of the engine. An ignition coil circuit and an injector circuit are formed integrally in a case of the engine control unit. A connector for connecting a sensor circuit to the engine control unit and a harness connecting connector are formed on a peripheral wall surface of the case of the engine control unit.

5 Claims, 5 Drawing Sheets

ENGINE CONTROL UNIT

BACKGROUND OF THE INVENTION

1. Field of the Invention

The present invention relates to an engine control unit mounted on an engine and a wire harness for an engine of an automobile, and particularly to a mount position of the engine control unit and rationalization of wiring of the wire harness.

2. Description of the Related Art

Heretofore, ignition timing, fuel injection amount, etc. of an engine in an automobile are controlled in high-level and high-speed, and reliability and durability are required therefor. In response to such a requirement, electronic control is generally used and an engine control unit (hereinafter referred to as "ECU") for performing the various kinds of control integrally is employed.

FIG. 4 is a view showing arrangement of components in an engine room of an automobile in the related-art.

Provided in FIG. 4 are a lateral disposed engine 10, an engine room 11, an engine room harness 13, and an engine harness 12.

The engine room harness 13 is divided broadly into a right side harness 13-1, a left side harness 13-2, and a front harness 13-3. The right and left side harnesses 13-1 and 13-2 branch off to be connected to a wiper component 20, a brake component 30, a relay box 40, etc.

Further, the front harness 13-3 branches off so as to be connected to a lamp component 50; a component 60 of a cooling system such as a radiator fan; and a component 65 of an air conditioner system such as a compressor of an air conditioner.

Broadly, the engine harness 12 includes: paths 12-1 and 12-2 wired from an ECU 110 disposed on an assistant seat side in a cabin to engine injectors 100; a path 12-3 connected to a water temperature sensor 80; paths 12-4 and 12-5 branching off from the middle of the path 12-1 so as to be connected to ignition coils 90; and paths 12-6 and 12-7 extended from the paths 12-4 and 12-5 so as to be connected to a battery 120 through a fusible link holder 70.

FIG. 5 is an example of a block diagram of the ECU in the related-art example. The ECU 110 includes electronic components such as a CPU, an ROM, and an RAM, and various circuits. The ECU 110 is supplied with signals from various sensors such as an intake air temperature sensor, and a water temperature sensor, controls and processes these signals, and then outputs these processed signals to a coil, an injector, and so on.

As shown in FIG. 4, the wire harnesses 12-1 and 12-3 make connection between the ECU 110 and the water temperature sensor 80, the wire harnesses 12-1, 12-4 and 12-5 make connection between the ECU 110 and the coils 90, and the wire harnesses 12-1 and 12-2 make connection between the ECU 110 and the injectors 100.

In the related-art, however, the ECU 110 is disposed on the assistant seat side in the cabin, while the injectors 100 and the ignition coils 90 are mounted on the engine 10. Accordingly, it is required to wire a long harness from the ECU 110 in the cabin to the injectors 100 and the ignition coils 90 in the engine room 11. Working area for this wire harness connection is required to extend over two places, that is, in the cabin and the engine room 11. There is therefore a problem in performing such work smoothly.

SUMMARY OF THE INVENTION

The invention has been made in consideration of the problem. It is an object of the invention to provide an ECU mounted on the engine body to simplify wiring of a wire harness to thereby make the assembly work smooth and make cost of the components lower.

In order to achieve the object, according to a first configuration, there is provided an engine control unit having electronic components and various circuits for controlling an engine, the engine control unit being mounted on a portion substantially just above an intake manifold of the engine.

According to a second configuration, in the engine control unit defined in the first configuration, an ignition coil circuit and an injector circuit are formed integrally in a case of the engine control unit so that control circuits of a control board are connected to an ignition coil and an injector by slot-in-connectors respectively.

According to a third configuration, in the engine control unit defined in the first or second configuration, a connector for connecting a sensor circuit to the engine control unit and a harness connecting connector are formed on a peripheral wall surface of the case of the engine control unit.

According to a fourth configuration, in the engine control unit defined in any one of the first through third configurations, a fuel flow channel is formed in a lower surface of the case of the engine control unit.

DETAILED DESCRIPTION OF THE PRESENT INVENTION

Figure 1:
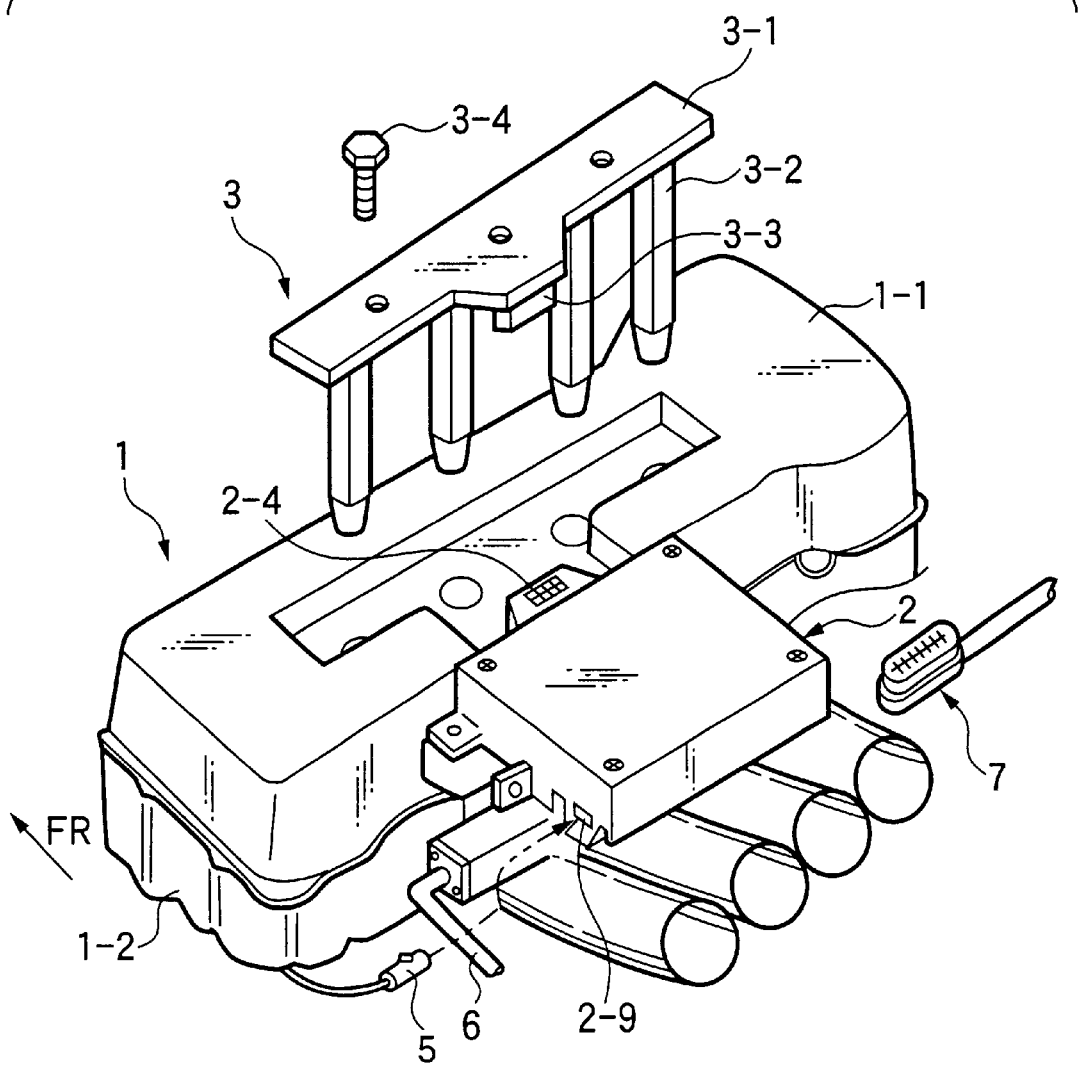
FIG. 1 is a perspective view of an ECU mounted on an engine according to an embodiment of the invention.

FIG. 1 is a perspective view showing an ECU mounted on an engine viewed from obliquely above, according to an embodiment of the invention.

Figure 2:
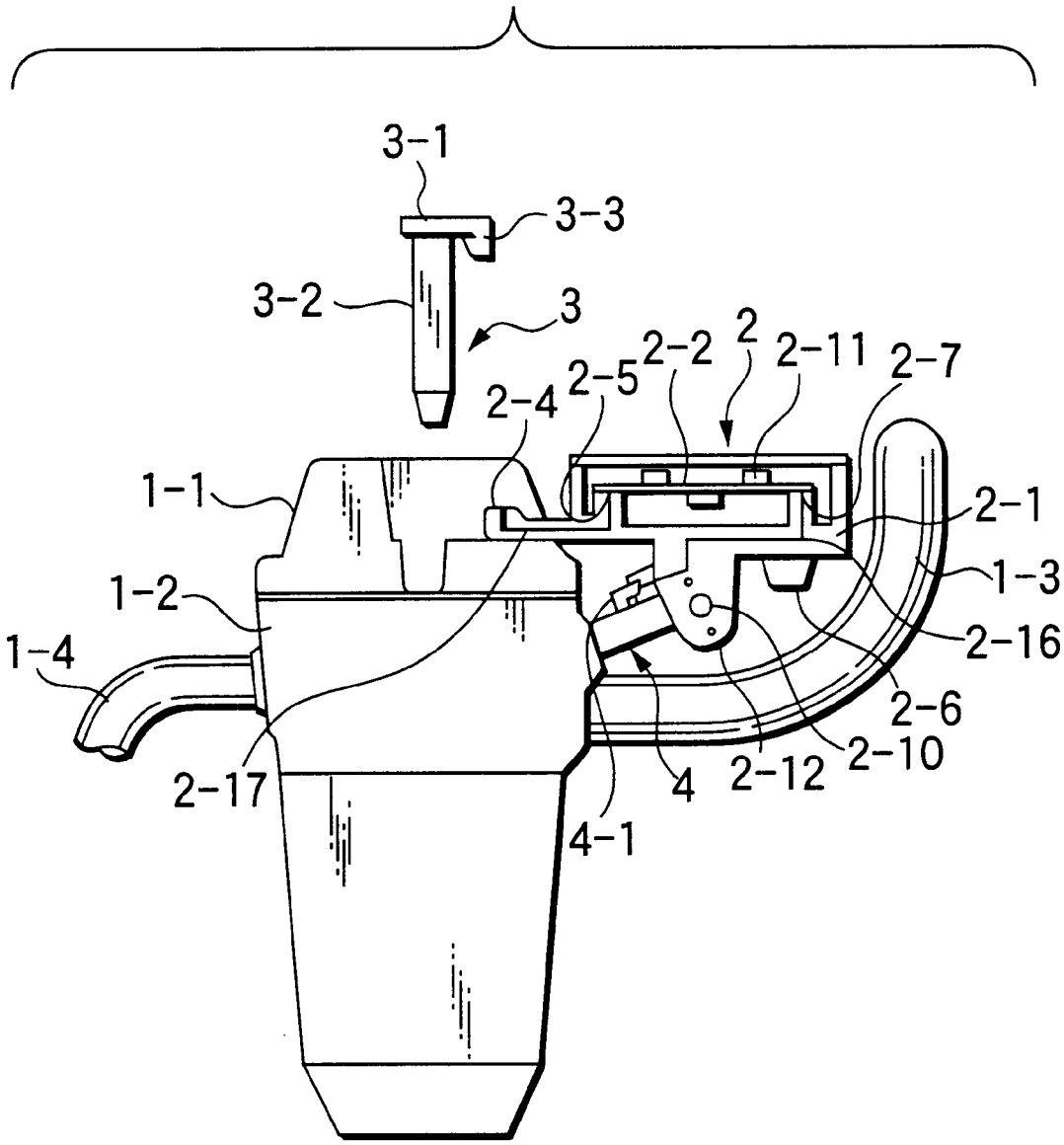
FIG. 2 is a sectional view of FIG. 1.
Figure 3:
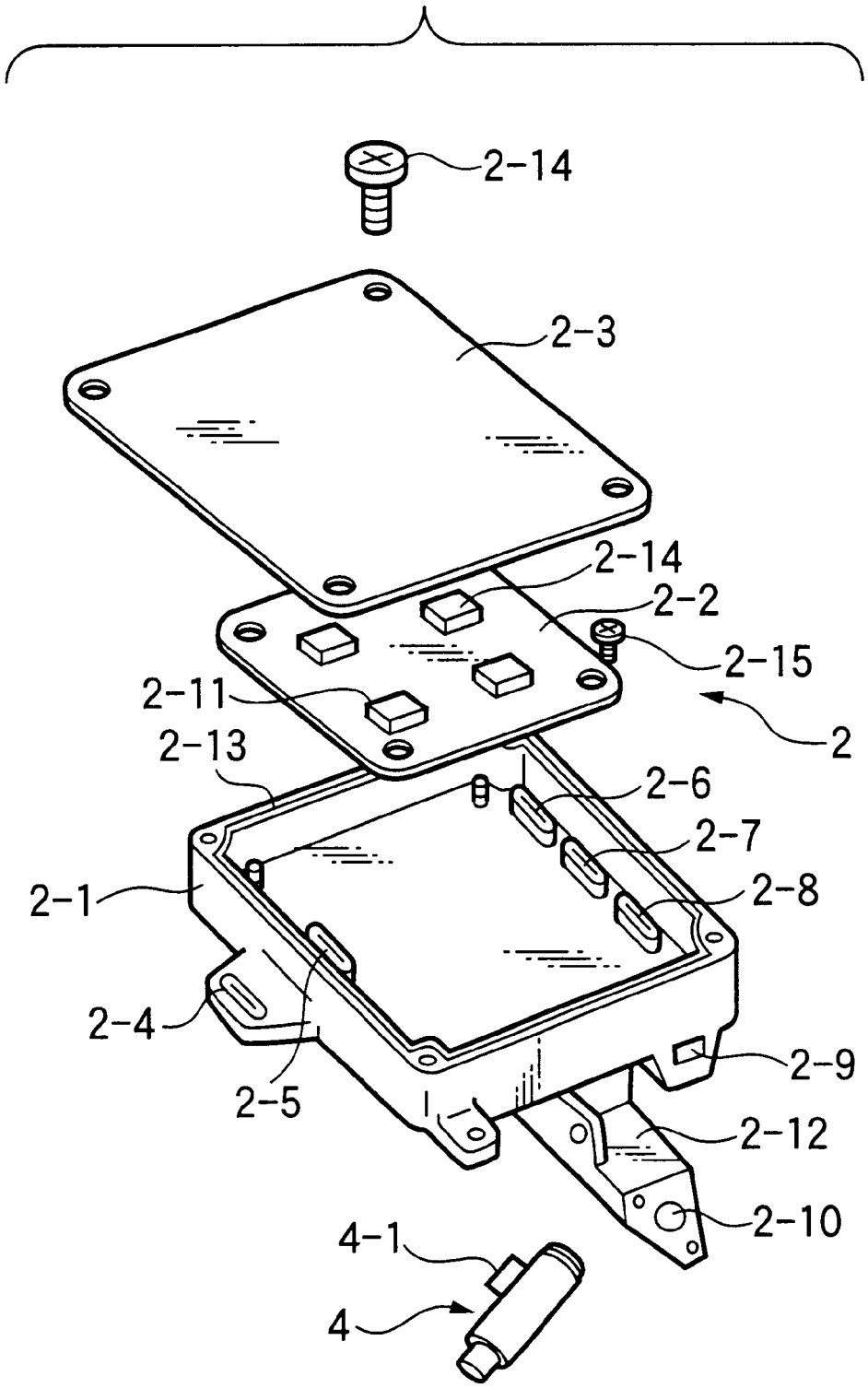
FIG. 3 is an exploded perspective view of the ECU according to the embodiment of the invention.
Figure 4:
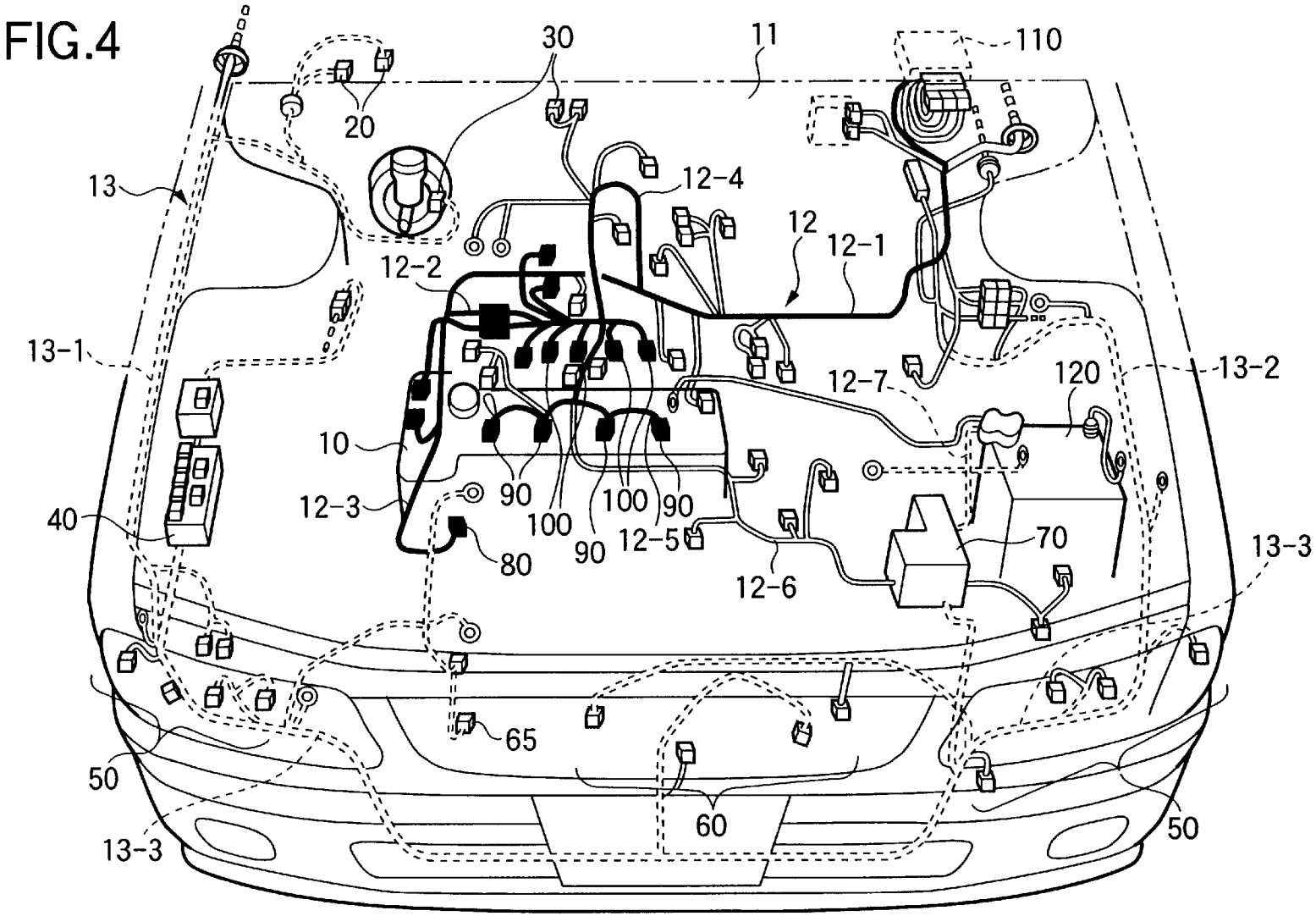
FIG. 4 is a view of arrangement of components in an engine room of an automobile according to a related-art example.
Figure 5:
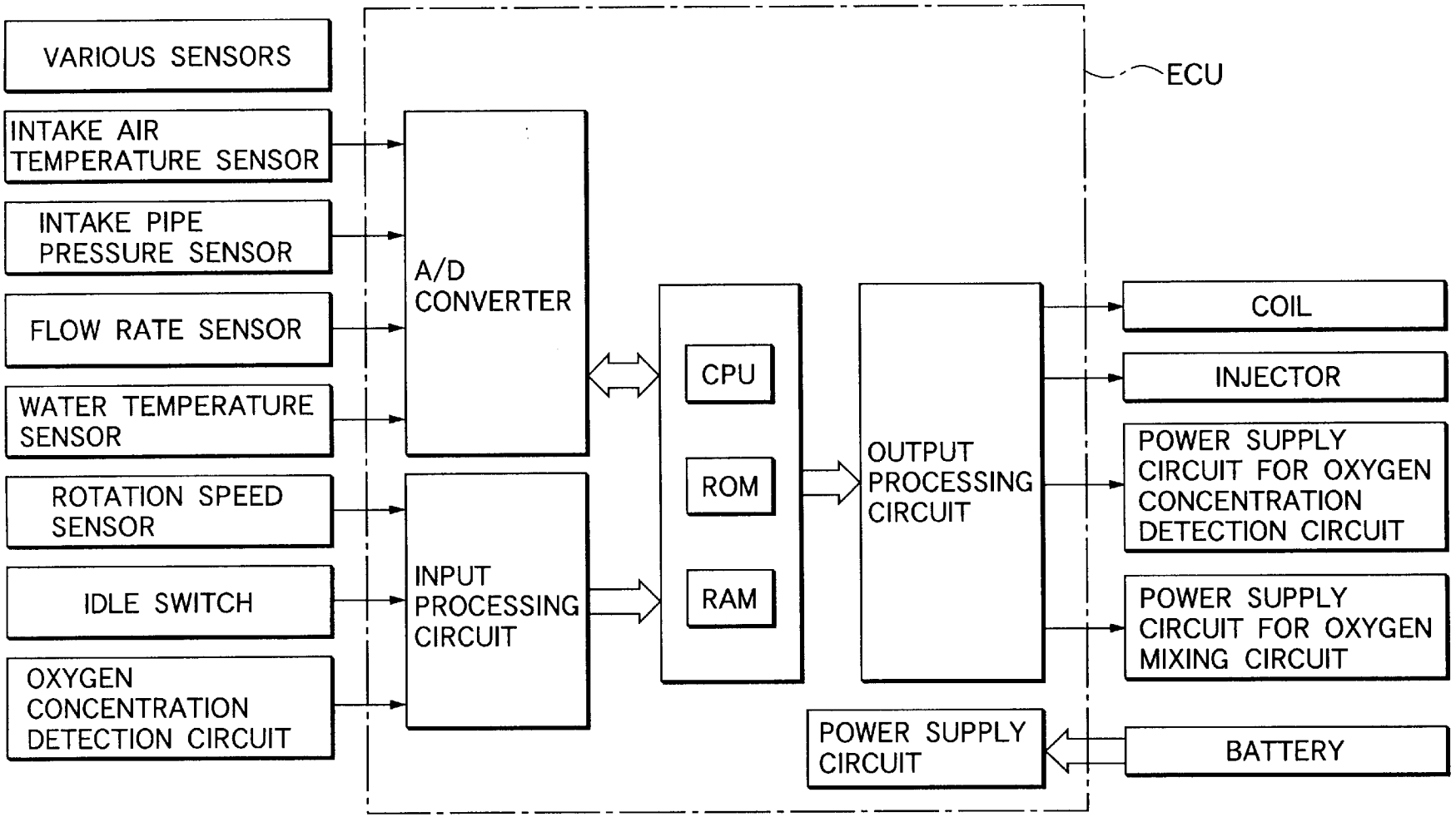
FIG. 5 is a block diagram of the ECU according to the related-art.

FIG. 2 is a section of FIG. 1, and FIG. 3 is an exploded perspective view of the ECU according to the embodiment of the invention.

In FIGS. 1 and 2, there are provided a lateral disposed engine 1, a rocker cover 1-1 made of resin or made of aluminum die-casted, and a cylinder head 1-2 made of aluminum die-casted.

An ECU 2 is fixed by a bracket and a bolt-and-nut (not shown) on a side of the rocker cover 1-1 and to a portion substantially just above the intake manifold 1-3.

An ignition coil assembly 3 includes a base portion 3-1, ignition coil portions 3-2, and a slot-in-connector 3-3 for an electric circuit which communicates with a slot-in-connector 2-4 of the ECU.

The ignition coil portions 3-2 are inserted into ignition plugs of the cylinder head 1-2 through a hole in an upper-surface of the rocker cover 1-1, so that the ignition coil assembly 3 is fixed on the rocker cover 1-1 by bolts 3-4.

An injector 4 for injecting fuel into an combustion chamber of the engine is fixed by bolts (not shown) on a side surface of the cylinder head 1-2. The injector 4 has a connector 4-1 for an electric circuit transmitting a control signal for controlling the injector 4.

A connector 5 connects a water temperature sensor and the ECU 2.

A duct 6 feeds fuel to the engine 1.

A connector 7 connects the ECU 2 and an engine room harness with each other.

In FIGS. 2 and 3, there is provided a lower case 2-1 formed by injection-molding engineering plastic. On one side of the bottom surface of the lower case 2-1, there are provided a connector 2-6 for connection of an engine room harness, a slot-in-connector 2-7 for an injector circuit, and a connector 2-8 for a water temperature sensor circuit.

Further, on a side opposite to the side of the bottom surface, a connector 2-5 for a coil circuit is provided. A slot-in-connector 2-4 fitted to the slot-in-connector 3-3 for a coil is provided outside the connector 2-5. On an outside surface of a further other side of the bottom surface, a connector 2-9 for the water temperature sensor circuit is provided.

The slot-in-connectors 2-4 and 2-5 are connected to each other through a bus bar 2-17 which is integrally molded with the lower case 2-1.

Similarly, the slot-in-connectors 2-7 and 4-1 are connected to each other through a bus bar 2-16 which is integrally molded with the lower case 2-1.

A control board 2-2 is made of resin. On the control board 2-2, electronic components such as a CPU, an ROM, and an RAM various are mounted, and circuits such as a power source circuit an output processing circuit, and an input processing circuit for engine control are configured.

Further, terminals (not shown) of connectors to be connected with the slot-in-connectors 2-5, 2-6, 2-7 and 2-8 are soldered to a lower surface of the control board 2-2.

The control board is fixed to the lower case 2-1 by the four bolts 2-15 while the soldered terminals of connectors are fit to the slot-in-connectors 2-5, 2-6, 2-7 and 2-8 respectively.

Further, from above the control board 2-2, the lower case 2-1 is covered with an upper case 2-3 made of metal, and the upper case 2-3 is fixed to the lower case 2-1 by four bolts 2-14 through a seal packing 2-13.

A protrusion portion 2-12 is formed continuously to the lower surface of the lower case 2-1, and a cylindrical hole 2-10 is formed in the inside of the protrusion portion 2-12 so as to serve as a flow channel to feed fuel to the engine.

Because the fuel duct 6 is connected to the end of the cylindrical hole 2-10, no exclusive fuel duct to the fuel duct 6 is required. At the same time, the fuel duct 6 has a function to cool the surrounding electronic components.

The injector 4 has one end fixed to the cylinder head 1-2 by bolts (not shown), and the other end fixed to the protrusion portion 2-12 of the lower case 2-1 and connected to the fuel flow channel 2-10.

Similarly, the connector 4-1 for the injector is fitted to the bus bar 2-16.

Next, description is made on the connection of the ECU 2 mounted on the engine 1, to the fuel duct 6, the connector 5 for the water temperature circuit, and the connector 7 for the connection of the engine room harness.

First, the engine 1 having the ECU 2 mounted on the rocker cover 1-1 of the engine is mounted on a vehicle, and the fuel duct 6 is connected to the fuel flow channel 2-10 of the lower case.

Next, the sensor connector 2-9 on the lower case side and the water temperature sensor circuit connector 5 on the engine room side are fitted to each other.

Then, the harness connecting connector 2-6 on the lower case side and the engine room harness connecting connector 7 are fitted to each other to thereby complete predetermined circuits.

According to the embodiment having such a configuration as mentioned above, electronic components such as a CPU, an ROM and an RAM, and circuits such as a power source circuit, an output processing circuit, and an input processing circuit are formed on the control board 2-2, and the control board 2-2 is received in the cases 2-1 and 2-3. The cases 2-1 and 2-3 are then mounted on the engine 1, and the ECU 2 side connectors are provided on the peripheral surface of the lower case 2-1 of the ECU. Accordingly, the harness connection work after the engine 1 is mounted on the vehicle becomes easy because the connection work is abridged into a first fitting work between the engine room harness connecting connector 2-6 on the ECU lower case 2-1 side and the connector 7 on the engine room side, and a second fitting work between the water temperature sensor circuit connector 2-9 on the ECU lower case 2-1 side and the connector 5 on the engine room side.

Further, the wiring path of the wire harnesses is shortened, and the number of the connectors is reduced, so that an engine control unit low in cost and high in reliability can be obtained.

Further, electronic components for a control system are abridged in a single engine, so that, on the occasion of examination after engine assembly, no examination by use of a checker harness is necessary and the number of steps of attachment/detachment of the checker harness can be reduced.

Further, the flow channel path 2-10 is provided in the lower case 2-1, and the ECU 2 is offset from the center of the engine 1 and attached to the intake manifold 1-3 where the temperature is relatively low. Accordingly, the influence of heat from the engine to the ECU 2 can be reduced. Further, it is possible to expect an effect that the ECU electronic components 2-11 can be cooled by circulating fuel.

Although the embodiment has been described on the water temperature sensor, the invention is not limited to the water temperature sensor, but can be applied to various sensors.

According to the invention, the ECU is mounted on the engine, so that the path of the wire harness is simplified and shortened, the wiring work is made easy, and the cost of the components is reduced.

Further, an engine control unit is offset from the center of the engine so as to be mounted on a portion substantially just above an intake manifold of the engine where the temperature is relatively low. Accordingly, there can be obtained an effect that the influence of heat from the engine to the engine control unit can be reduced.

Further, the electronic components for engine control can be abridged in a single engine. Accordingly, examination by use of a checker harness on the occasion of examination after assembly of the engine becomes unnecessary, so that there can be obtained an effect that the number of steps for attachment/detachment of the checker harness can be reduced.

According to the invention, an ignition coil circuit and an injector circuit are formed integrally in a case of the engine control unit. Circuits of a control board are connected to an ignition coil and an injector by slot-in-connectors respectively. Accordingly, there can be obtained effects that the path of the wire harness is shortened and simplified, the wire harness assembling work is made easy, and the cost of the components is reduced.

According to the invention, a connector for connecting a sensor circuit to the engine control unit and an engine room harness connecting connector are formed on a peripheral wall surface of the case of the engine control unit. Accordingly, there can be obtained an effect that work can be conducted smoothly while working area for wire harness assembling does not extend over the cabin and the engine room.

According to the invention, the engine control unit is made offset from the center of the engine so as to be mounted on a portion substantially just above an intake manifold of the engine where the temperature is relatively low, and a fuel flow channel is formed in a lower surface of the case of the engine control unit. Accordingly, there can be expected an effect that the electronic components of the ECU can be cooled by the circulating fuel.

What is claimed is:

1. An engine control unit for electronic components and circuits for controlling the engine, comprising:

a case; and a control board accommodated in the case, wherein an ignition coil circuit and an injector circuit is integrally formed with the case, and wherein the engine control unit is mounted on a portion substantially just above and within an upper space of an intake manifold of the engine in the vicinity of the engine, the intake manifold disposed at a side face of the engine and extending outwardly from the engine.

2. The engine control unit according to claim 1, further comprising a slot-in-connector for connecting the control board to the ignition coil circuit and the injector circuit.

3. The engine control unit according to claim 1, further comprising:

a first connector for connecting a sensor circuit to the engine control unit; and a second connector for connecting a harness to the engine control circuit, wherein the first connector and the second connector are disposed on a peripheral wall surface of the case.

4. An engine control unit for electronic components and circuits for controlling the engine, the engine control unit mounted on a portion substantially just above and within an upper space of an intake manifold of an engine in the vicinity of the engine, the intake manifold disposed at a side face of the engine and extending outwardly from the engine, wherein a fuel flow channel is formed in a lower surface of a case of the engine control unit.

5. An engine control unit for electronic components and circuits for controlling the engine, the engine control unit mounted on a portion substantially just above an intake manifold of the engine, wherein a fuel flow channel is formed in a lower surface of a case of the engine control unit.

* * * * *